US011520278B2

(12) United States Patent
Ichikawa

(10) Patent No.: US 11,520,278 B2
(45) Date of Patent: Dec. 6, 2022

(54) TRANSPORT MEMBER, TRANSPORT DEVICE, AND IMAGE FORMING APPARATUS

(71) Applicant: FUJIFILM Business Innovation Corp., Tokyo (JP)

(72) Inventor: Yuzo Ichikawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 542 days.

(21) Appl. No.: 16/517,023

(22) Filed: Jul. 19, 2019

(65) Prior Publication Data

US 2020/0301347 A1 Sep. 24, 2020

(30) Foreign Application Priority Data

Mar. 22, 2019 (JP) ..... JP2019-054308

(51) Int. Cl.
*G03G 21/00* (2006.01)
*G03G 15/08* (2006.01)
*G03G 21/12* (2006.01)

(52) U.S. Cl.
CPC ..... *G03G 21/007* (2013.01); *G03G 15/0891* (2013.01); *G03G 15/0896* (2013.01); *G03G 21/12* (2013.01)

(58) Field of Classification Search
CPC ..... G03G 21/007; G03G 15/0891; G03G 15/0896; G03G 21/12
See application file for complete search history.

(56) References Cited

U.S. PATENT DOCUMENTS 10,114,313 B2 10/2018 Tsuji
2015/0346638 A1* 12/2015 Mizusawa ..... G03G 15/0891 399/358
2018/0284687 A1* 10/2018 Ando ..... G03G 21/105

FOREIGN PATENT DOCUMENTS

CN 209922248 U * 1/2020
JP 2007-256740 A 10/2007
JP 2007-286322 A 11/2007
JP 2017-198863 A 11/2017
KR 100939737 B1 * 1/2010

* cited by examiner

*Primary Examiner* — G. M. A Hyder
(74) *Attorney, Agent, or Firm* — Sughrue Mion, PLLC

(57) ABSTRACT

A transport member includes a shaft and plural blades that extend around the shaft so as to transport a target object that is to be transported and that is present around the plural blades in a direction in which the shaft extends by rotating with the shaft, the plural blades extending in at least a region of the transport member in the direction in which the shaft extends in such a manner that the plural blades are sequentially out of phase with one another in a direction in which the plural blades rotate. The at least a portion in the direction in which the shaft extends has flexibility.

12 Claims, 5 Drawing Sheets

TRANSPORT MEMBER, TRANSPORT DEVICE, AND IMAGE FORMING APPARATUS

CROSS-REFERENCE TO RELATED APPLICATIONS

This application is based on and claims priority under 35 USC 119 from Japanese Patent Application No. 2019-054308 filed Mar. 22, 2019.

BACKGROUND

(i) Technical Field

The present disclosure relates to a transport member, a transport device, and an image forming apparatus.

(ii) Related Art

There is known a transport device having a structure in which a transport member that rotates to transport powder is disposed in a tube used for transporting the powder and is caused to rotate. For example, a so-called electrophotographic image forming apparatus that forms an image by using toner, which is in the state of powder, includes a transport device having the above-mentioned structure as a transport device that transports waste toner to a waste-toner tank.

Here, the above-mentioned tube does not necessarily extend linearly and may sometimes include a curved portion that is formed at a position partway along a transport path. Accordingly, there is known a flexible transport member that is to be disposed in a tube including a curved portion.

For example, Japanese Unexamined Patent Application Publication No. 2007-256740 discloses a transport member that is formed in the shape of a coil spring and that includes a portion to be disposed in a curved portion of a tube, the portion of the transport member having a spiral pitch smaller than the spiral pitch of another portion of the transport member that is to be disposed in a linear portion of the tube.

Japanese Unexamined Patent Application Publication No. 2007-286322 discloses a transport member that is made of an elastomer. This transport member includes a first transport portion having a shaft and a coil-shaped portion, which is formed on the outer periphery of the shaft, the shaft and the coil-shaped portion being integrally formed by using a resin material, and a second transport portion that is formed in a coil shape by using a resin and that is to be disposed in a curved portion of a transport path.

Assume the case where a transport member that has transport capacity generally higher than that of a transport member formed in the shape of a coil spring and that includes a shaft and a helical blade, which extends on the outer periphery of the shaft, the helical blade being configured to rotate with the shaft so as to transport powder which is present around the blade in a direction in which the shaft extends, is disposed in a hollow tube that includes a curved portion and is caused to rotate so as to transport powder which is present in the hollow space of the tube. In this case, the transport member needs to be made of, for example, an elastic material such as an elastomer. Note that the transport member does not continuously keep rotating and stops rotating when, for example, the operation of a device that includes the transport member is stopped. If the transport member is not rotating for a long period of time, although the transport member is made of, for example, an elastic material such as an elastomer, the transport member will become somewhat hardened while keeping its stationary position. Thus, when the transport member is caused to rotate again by starting the operation of the device, there is a possibility that an end of a portion of the transport member, the portion having become hardened while being in the bent position in the curved portion, will come into contact with the inner wall of the tube, which in turn results in generation of noise.

SUMMARY

Aspects of non-limiting embodiments of the present disclosure relate to providing a transport member that includes a long-length helical blade and that has flexibility higher than that of a transport member including a long-length helical blade that is to be disposed also in a curved portion, a transport device that includes the transport member and that transports an object that is to be transported, and an image forming apparatus that transports toner by using the transport device.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a transport member including a shaft and a plurality of blades that extend around the shaft so as to transport a target object that is to be transported and that is present around the plurality of blades in a direction in which the shaft extends by rotating with the shaft, the plurality of blades extending in at least a region of the transport member in the direction in which the shaft extends in such a manner that the plurality of blades are sequentially out of phase with one another in a direction in which the plurality of blades rotate. The at least a portion in the direction in which the shaft extends has flexibility.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below.

Figure 1:
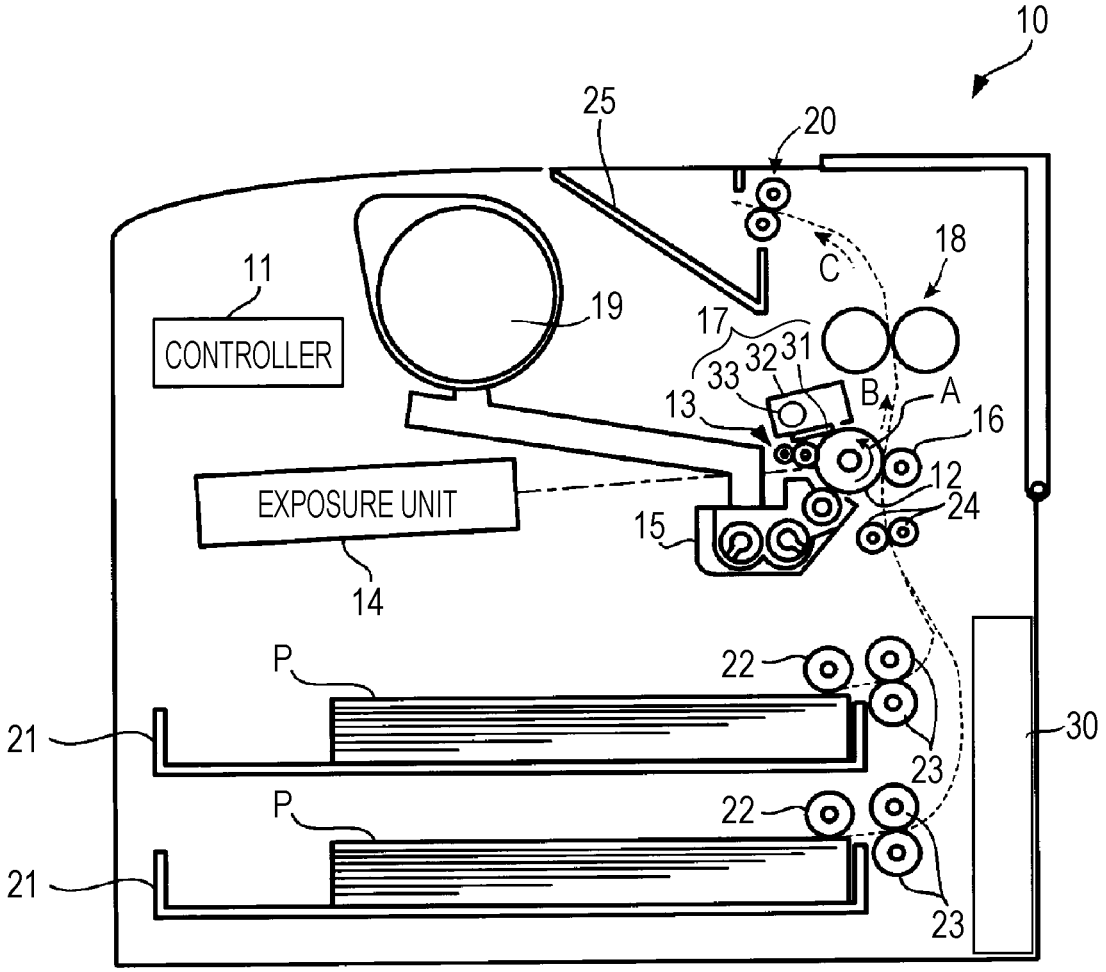
FIG. 1 is a schematic diagram illustrating a configuration of a printer that is an image forming apparatus according to an exemplary embodiment of the present disclosure.

FIG. 1 is a schematic diagram illustrating the configuration of a printer that is an image forming apparatus according to an exemplary embodiment of the present disclosure. A transport device according to an exemplary embodiment of the present disclosure and a transport member according to an exemplary embodiment of the present disclosure are incorporated in the printer.

A printer 10 that is illustrated in FIG. 1 is a so-called black-and-white printer that employs an electrophotographic system, and an image signal representing an image, the image signal being generated by an apparatus, such as a personal computer or the like, that is different from the printer 10, is input to the printer 10 via a signal cable or the like (not illustrated). The printer 10 includes a controller 11 that controls the operation of each component included in the printer 10, and the image signal is input to the controller 11. The printer 10 performs, under control of the controller 11, image formation based on the image signal.

The controller 11 has a function of serving as an information processing apparatus that includes a central processing unit (CPU), which runs a program, and memory. In the printer 10, an image forming operation is controlled as a result of a control program being run in the controller 11.

The printer 10 includes sheet trays 21 that are disposed in a lower portion of the printer 10, and sheets P are stacked on top of one another in each of the sheet trays 21. The sheet trays 21 are configured to be capable of being drawn out to be supplied with the sheets P. The sizes of the sheets P, which are to be accommodated in the sheet trays 21, may sometimes be changed by a user, and in addition, the sheets P having different sizes or different thicknesses may sometimes be accommodated in the plurality of sheet trays 21. The controller 11 recognizes the sizes and the thicknesses of the sheets P that are actually accommodated in the sheet trays 21 and uses the information regarding their sizes and thicknesses for controlling each unit of the printer 10. Although not illustrated, an automatic-recognition mechanism that includes, for example, a sensor or a recognition mechanism that operates in response to, for example, an input from a user is incorporated in the printer 10, and the mechanism is required for the above recognition.

Each of the sheets P in the sheet trays 21 is to be sent to standby rollers 24 by a pickup roller 22 and a pair of separation rollers 23. The timing of transportation of one of the sheets P that has reached the standby rollers 24 is adjusted, and the sheet P is further transported.

The printer 10 includes an image carrier 12 that has a cylindrical shape and rotates in the direction of arrow A, and a charger 13, an exposure unit 14, a developing unit 15, a transfer unit 16, and a cleaner 17 are disposed around the image carrier 12. The image carrier 12 corresponds to an example of an image holding unit according to an exemplary embodiment of the present disclosure. A configuration that includes the image carrier 12 and the peripheral units, which are the charger 13, the exposure unit 14, the developing unit 15, the transfer unit 16, and the cleaner 17, corresponds to an example of an image forming unit according to an exemplary embodiment of the present disclosure.

The charger 13 charges a surface of the image carrier 12, and the exposure unit 14 exposes the surface of the image carrier 12 to light in accordance with an image signal sent from the controller 11 and forms an electrostatic latent image. The developing unit 15 develops an electrostatic latent image, which has been formed on the image carrier 12, with a toner. As a result of performing this development operation, a toner image is formed onto the image carrier 12.

The printer 10 includes a toner bottle 19 that contains the toner, and when the toner is used by the developing unit 15, the toner is supplied to the developing unit 15 from the toner bottle 19.

The standby rollers 24 send out one of the sheets P in such a manner that the sheet P reaches a position facing the transfer unit 16 in accordance with the timing at which a toner image formed on the image carrier 12 reaches the position. Then, the toner image formed on the image carrier 12 is transferred onto the sheet P, which has been sent out, by operation of the transfer unit 16. As a result, an unfixed toner image is formed onto the sheet P.

Residual toner that remains on the image carrier 12 after the above transfer operation has been performed is removed from the image carrier 12 by the cleaner 17. Here, the cleaner 17 includes a blade 31 that scrapes off the residual toner remaining on the image carrier 12 by coming into contact with the image carrier 12, a containing unit 32 that contains the residual toner, which has been scraped off, while supporting the blade 31, and a transport member 33 that transports the residual toner contained in the containing unit 32 in a direction perpendicular to the plane in FIG. 1. The cleaner 17 corresponds to an example of a cleaning unit according to an exemplary embodiment of the present disclosure. The transport member 33 corresponds to an example of a transport member according to an exemplary embodiment of the present disclosure. Details of this matter will be described later.

The residual toner transported by the transport member 33 is contained into a waste-toner tank 30. The waste-toner tank 30 corresponds to an example of a storage unit according to an exemplary embodiment of the present disclosure. Note that the residual toner will hereinafter be referred to as waste toner because the residual toner is toner that is discarded into the waste-toner tank 30.

The sheet P to which an unfixed toner image has been transferred by the operation of the transfer unit 16 is further transported in the direction of arrow B, and the sheet P is heated and pressurized as a result of passing through a fixing unit 18. As a result, the unfixed toner image is fixed in place, and an image formed of the unfixed toner image is formed onto the sheet P.

The sheet P that has passed through the fixing unit 18 is transported in the direction of arrow C and ejected to a sheet output tray 25 by an ejection roller 20.

Figure 2:
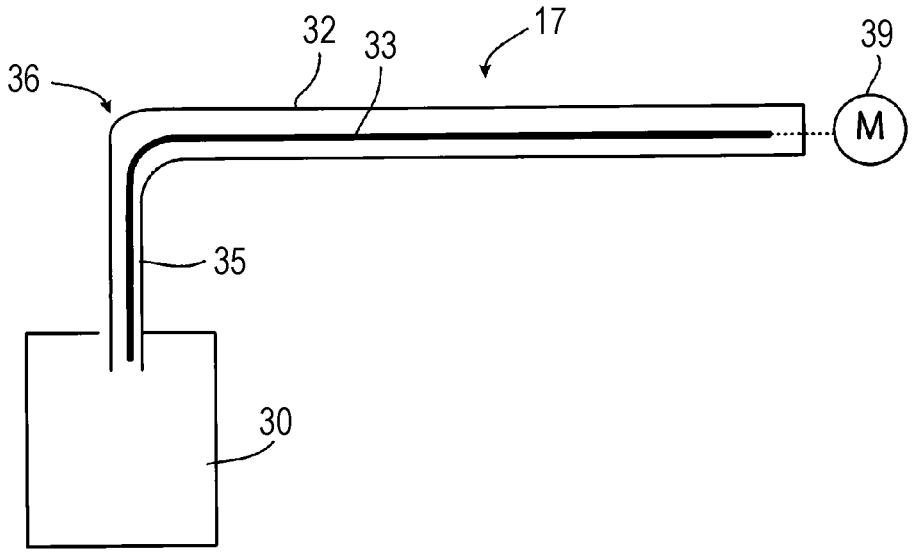
FIG. 2 is a schematic diagram of a waste-toner transport path extending from a cleaner to a waste-toner tank.

FIG. 2 is a schematic diagram of a waste-toner transport path extending from the cleaner to the waste-toner tank. The actual transport path is not as simple as that illustrated in FIG. 2, the transport path is illustrated in a simplified manner in FIG. 2.

FIG. 2 illustrates the containing unit 32 of the cleaner 17 and the transport member 33, which is disposed in the containing unit 32. The transport member 33 rotates as a result of being driven by a motor 39 so as to transport the waste toner. The containing unit 32 of the cleaner 17 and the waste-toner tank 30 are connected to each other by a transport tube 35. The transport member 33 disposed in the containing unit 32 of the cleaner 17 also extends in the transport tube 35. Here, a connecting portion 36 that connects the containing unit 32 of the cleaner 17 and the transport tube 35 to each other is curved, and accordingly, the transport member 33 is bent in an arc-like manner in the connecting portion 36. In other words, the transport member 33 rotates while being bent in the connecting portion 36, which is curved. Thus, the transport member 33 is required to have sufficient flexibility to rotate while being bent in addition to sufficient transport capacity. In order to satisfy this requirement, an elastomer is used as the material of the transport member 33. Here, a combination of the containing unit 32 and the transport tube 35 corresponds to an example of a tube according to an exemplary embodiment of the present disclosure, and the connecting portion 36 corresponds to an example of a curved portion according to an exemplary embodiment of the present disclosure. The motor 39 corresponds to an example of a driving unit according to an exemplary embodiment of the present disclosure.

Before describing the transport member 33 according to an exemplary embodiment of the present disclosure, a transport member that is a comparative example will now be described. For ease of understanding, in the following description, the transport member that is the comparative example and the peripheral components will be denoted by the same reference signs as the transport member 33 and the peripheral components according to the exemplary embodiment. Although not illustrated, the transport member 33 that is the comparative example includes a shaft that has a circular cross section and a helical blade that is wound around the shaft a large number of times in a helical manner and has a configuration in which the helical blade also extends in the connecting portion 36.

Although the transport member 33 maintains substantially sufficient flexibility when it keeps rotating, the transport member 33 does not continuously keep rotating and stops rotating when, for example, the operation of the device that includes the transport member 33 is stopped. If the transport member 33 is not rotating for a long period of time, although the transport member 33 is made of an elastomer having elasticity, the transport member 33 will have a so-called bending tendency, that is, the transport member 33 will become somewhat hardened while keeping its stationary position. In particular, the bending tendency may sometimes become pronounced when the transport member 33 has been left as is for a long period of time in a high-temperature environment.

Thus, when the transport member 33 is caused to rotate again by starting the operation of the device, there is a possibility that an end of a portion of the transport member 33, the portion having become hardened while being in a bent position in the curved connecting portion 36, will come into contact with the inner wall of the transport tube 35, which in turn results in generation of noise.

The transport member 33 according to an exemplary embodiment, which will be described below, is a transport member that includes a bent portion having flexibility higher than the flexibility of the bent portion of the transport member that has been described above as the comparative example.

Figure 3A:
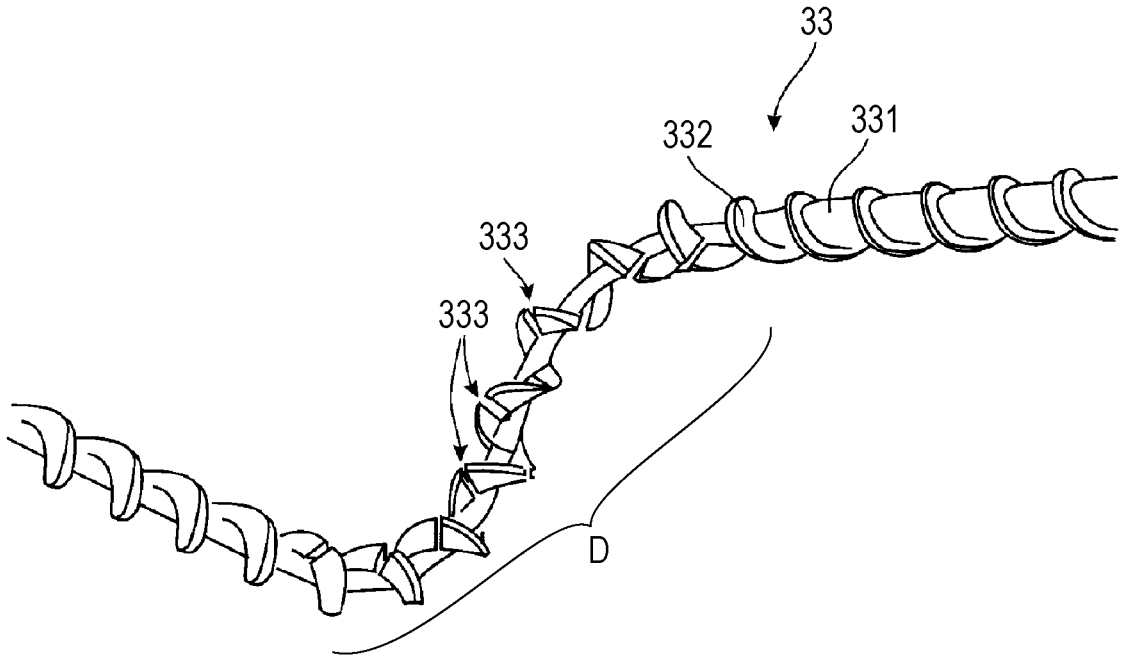
FIG. 3A and FIG. 3B are respectively a perspective view of a transport member according to a first exemplary embodiment of the present disclosure and a schematic diagram illustrating a portion of the transport member that is located in a region D illustrated in FIG. 3A as viewed in a direction in which a shaft of the transport member extends when the shaft is straightened.
Figure 3B:
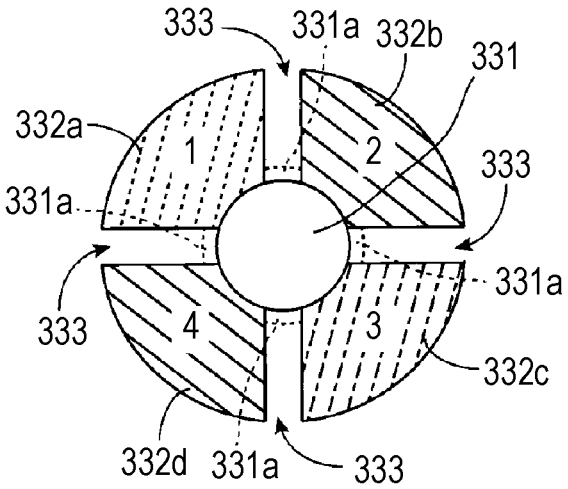

FIG. 3A is a perspective view of the transport member according to the first exemplary embodiment of the present disclosure, and FIG. 3B is a schematic diagram illustrating a portion of the transport member that is located in the region D illustrated in FIG. 3A as viewed in a direction in which the shaft of the transport member extends when the shaft is straightened.

The transport member 33 includes a shaft 331 that has a circular cross section and a helical blade 332 that is wound around the shaft 331 in a helical manner, and the shaft 331 and the helical blade 332 are integrally formed by using an elastomer. Note that, in the portion of the transport member 33 located in the region D, the helical blade 332 is divided by slits 333 at a plurality of positions (in this case, at four positions in each single-winding region in which the helical blade 332 is wound in one turn) in a direction in which the helical blade 332 rotates, each of the slits 333 being formed by cutting the helical blade 332 from a tip end of the helical blade 332 that is located farthest from the shaft 331 toward the shaft 331, so that a plurality of short blades 332*a*, 332*b*, 332*c*, and 332*d* are formed in the single-winding regions (in this case, four of these short blades are formed in each of the single-winding regions). Regarding the blades 332*a*, 332*b*, 332*c*, and 332*d*, which are formed such that four of them are formed in each of the single-winding regions, although FIG. 3B, which is a view in the direction in which the shaft 331 extends, only illustrates the four blades 332*a*, 332*b*, 332*c*, and 332*d* that are located on the near side as viewed in FIG. 3B, the rest of blades 332*a*, 332*b*, 332*c*, and 332*d* are formed in a repetitive manner in the entire region D. Each of the slits 333 may at least be a gap formed between two of the blades. As a method of forming the slits 333, the slits 333 may be formed by cutting a continuous blade or by forming cutout portions in a continuous blade or may be formed by forming a blade such that the blade originally has gaps.

The portion of the transport member 33 located in the region D is disposed in the connecting portion 36, which is illustrated in FIG. 2. The portion of the transport member 33 located in the region D may be bent much more flexibly than in the case where the long-length helical blade 332 is formed at the portion located in the region D.

Note that, in the case illustrated in FIGS. 3A and 3B, although the helical blade 332 is divided into the blades 332*a*, 332*b*, 332*c*, and 332*d* such that four of these blades are formed in each of the single-winding regions, the number of the blades that are formed in each of the single-winding by dividing the helical blade 332 is arbitrary. However, the helical blade 332 may be divided into three or more blades in order to ensure the flexibility.

In the transport member 33 illustrated in FIGS. 3A and 3B, a portion of the shaft 331 that is located in the region D is formed so as to be thin. This further improves the flexibility against the force that tries to bend the portion located in the region D. However, if the strength of the portion in the region D becomes too low due to this configuration, each of the slits 333 does not need to be a slit extending from the tip end of the helical blade 332 to the surface of the shaft 331, and as indicated by dotted lines in FIG. 3B, adjacent ones of the four blades 332*a*, 332*b*, 332*c*, and 332*d* formed in each of the single-winding regions may remain connected to each other by portions 331*a* that are formed in the vicinity of the shaft 331.

Figure 4A:
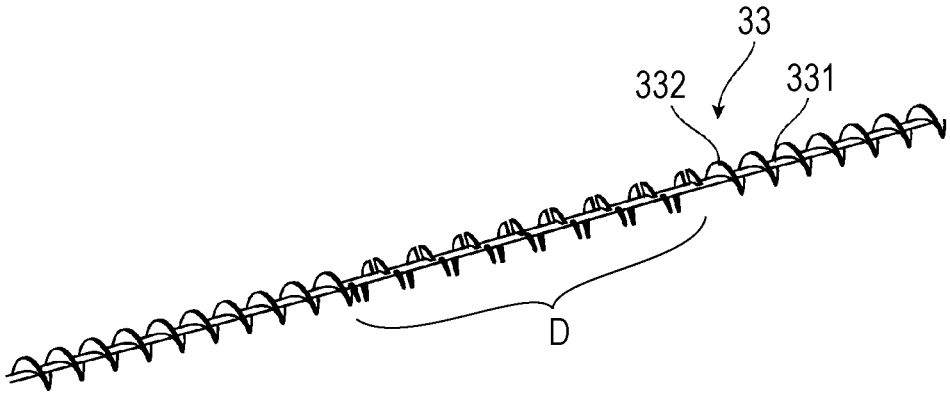
FIG. 4A and FIG. 4B are respectively a perspective view of a transport member according to a second exemplary embodiment of the present disclosure and a partially enlarged view of the transport member illustrated in FIG. 4A.
Figure 4B:
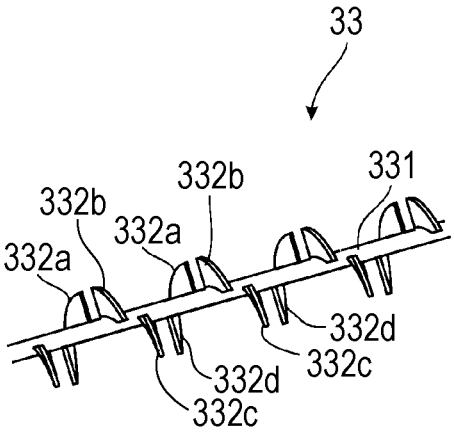

FIG. 4A is a perspective view of a transport member according to the second exemplary embodiment of the present disclosure, and FIG. 4B is a partially enlarged view of the transport member illustrated in FIG. 4A.

Figure 5A:
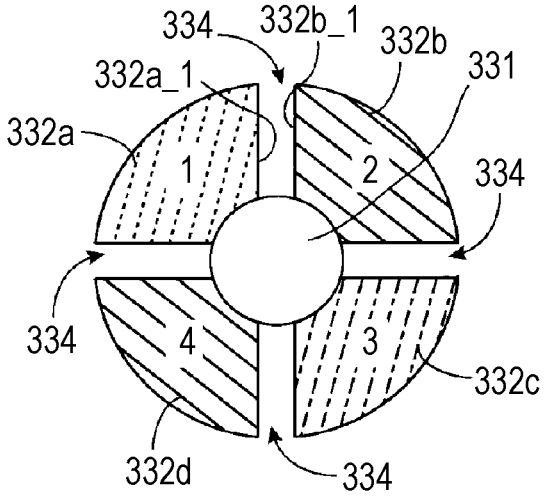
FIGS. 5A to 5C are schematic diagrams each illustrating a portion of the transport member that is located in a region D illustrated in FIGS. 4A and 4B when viewed in a direction in which a shaft of the transport member extends.
Figure 5B:
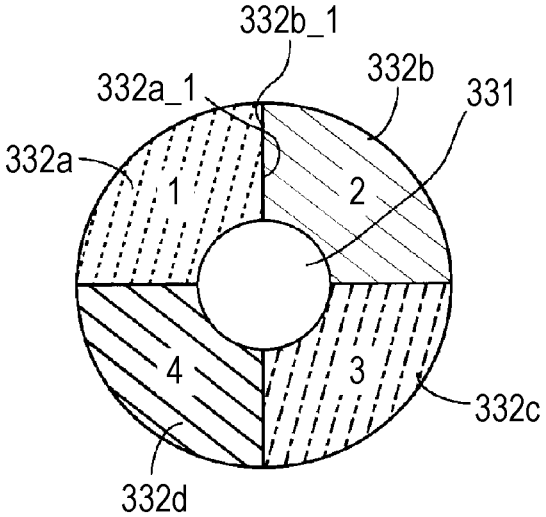
Figure 5C:
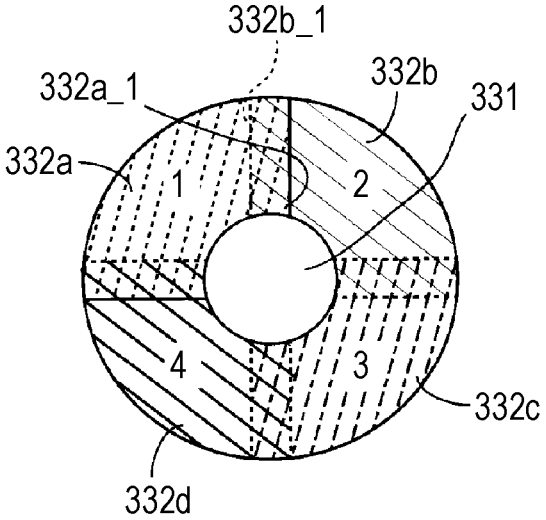

FIGS. 5A to 5C are schematic diagrams each illustrating a portion of the transport member that is located in a region D illustrated in FIGS. 4A and 4B when viewed in a direction in which a shaft of the transport member extends.

Similar to the transport member 33 according to the first exemplary embodiment, which is illustrated in FIGS. 3A and 3B, the transport member 33 according to the second exemplary embodiment includes the shaft 331 that has a circular cross section and the helical blade 332 that is wound around the shaft 331 in a helical manner, and the shaft 331 and the helical blade 332 are integrally formed by using an elastomer. Note that, similar to the first exemplary embodiment illustrated in FIGS. 3A and 3B, instead of a simple helical blade 332, the blades 332*a*, 332*b*, 332*c*, and 332*d* are formed at the portion of the transport member 33 that is located in the region D such that, as illustrated in FIG. 4B, four of these blades are formed in each single-winding region in which the helical blade 332 is wound in one turn. However, unlike the first exemplary embodiment illustrated in FIGS. 3A and 3B, adjacent ones of the four blades 332*a*, 332*b*, 332*c*, and 332*d*, which are formed in each of the single-winding regions, have end surfaces that are close to each other (e.g., an end surface 332*a*_1 of the blade 332*a* and an end surface 332*b*_1 of the blade 332*b* that are illustrated in FIGS. 5A, 5B, and 5C), and these end surfaces are located at positions that are sequentially displaced from each other in the direction in which the shaft 331 extends. In other words, in the first exemplary embodiment illustrated in FIGS. 3A and 3B, the four blades 332*a*, 332*b*, 332*c*, and 332*d*, which are formed in each of the single-winding regions, are blades formed by simply dividing the long-length helical blade 332 by the slits 333. In contrast, in the second exemplary embodiment, the blades 332*a*, 332*b*, 332*c*, and 332*d* are formed by dividing the long-length helical blade 332 and are sequentially displaced in the direction in which the shaft 331 extends.

The blades 332*a*, 332*b*, 332*c*, and 332*d* that are illustrated in FIG. 5A are formed at positions that are displaced from the positions of the blades 332*a*, 332*b*, 332*c*, and 332*d* according to the first exemplary embodiment illustrated in FIGS. 3A and 3B in the direction in which the shaft 331 extends. Thus, in FIG. 5A, gaps 334 that correspond to the slits 333 according to the first exemplary embodiment illustrated in FIGS. 3A and 3B appear when viewed in the direction in which the shaft 331 extends.

FIG. 5B illustrates four of the blades 332*a*, 332*b*, 332*c*, and 332*d* that are slightly widened so as to fill the gaps 334, which are illustrated in FIG. 5A, when viewed in the direction in which the shaft 331 extends. In the case illustrated in FIG. 5B, by slightly widening the four blades 332*a*, 332*b*, 332*c*, and 332*d*, the transport capacity of the transport member 33 to transport the waste toner is higher than in the case illustrated in FIG. 5A.

FIG. 5C illustrates four of the blades 332*a*, 332*b*, 332*c*, and 332*d* that are widened such that adjacent ones of the blades overlap each other when viewed in the direction in which the shaft 331 extends. When the blades are formed in this manner, the transport capacity of the transport member 33 to transport the waste toner is higher than in the case illustrated in FIG. 5B.

Note that, in the transport member 33 according to the first exemplary embodiment illustrated in FIGS. 3A and 3B and the transport member 33 according to the second exemplary embodiment illustrated in FIGS. 4A and 4B, the short blades 332*a*, 332*b*, 332*c*, and 332*d* are formed only at the portion of the transport member 33 located in the region D, and the helical blade 332 extends on both sides of the portion in the region D. However, for example, instead of the simple helical blade 332, the short blades 332*a*, 332*b*, 332*c*, and 332*d* may be formed across the entire transport member 33 including a portion of the transport member 33 that extends linearly.

Although the transport member 33 that transports the waste toner to the waste-toner tank 30 has been described above as an example, the transport member according to the present disclosure is not limited to the transport member 33 that transports the waste toner to the waste-toner tank 30. For example, the transport member according to the present disclosure may be a transport member or the like that transports the toner from the toner bottle 19 to the developing unit 15.

In addition, the transport member according to the present disclosure is not limited to a transport member that transports a toner, and the present disclosure may also be applied to transport members that transport various powder. Furthermore, the transport member according to the present disclosure is not limited to a transport member that transports powder, and the present disclosure may also be applied to transport members that transport, for example, sand, gravel, fresh concrete, and so forth.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transport member comprising:

a shaft; and a plurality of blades that extend around the shaft so as to transport a target object that is to be transported and that is present around the plurality of blades in a direction in which the shaft extends by rotating with the shaft, the plurality of blades extending in at least a region of the transport member in the direction in which the shaft extends in such a manner that the plurality of blades are sequentially out of phase with one another in a direction in which the plurality of blades rotate, wherein the at least a region of the transport member in the direction in which the shaft extends has flexibility.

2. The transport member according to claim 1, wherein the plurality of blades is comprised of a helical blade, which is wound around the shaft in a helical manner, and slits dividing the helical blade into the plurality of blades, wherein the plurality of blades are disposed at a plurality of positions in a rotation direction of the helical blade, and the slits are disposed at a plurality of positions in the rotation direction of the helical blade.

3. The transport member according to claim 2, wherein each of the slits is a slit extending from the tip end to a surface of the shaft.

4. The transport member according to claim 2, wherein the slits are disposed at at least three positions in a region in which the helical blade is wound in one turn in the rotation direction.

5. The transport member according to claim 3, wherein the slits are disposed at at least three positions in a region in which the helical blade is wound in one turn in the rotation direction.

6. The transport member according to claim 1, wherein adjacent ones of the plurality of blades have end surfaces that are close to each other, and the end surfaces are located at positions that are sequentially displaced from each other in the direction in which the shaft extends.

7. The transport member according to claim 6, wherein the plurality of blades are widened in such a manner that adjacent ones of the plurality of blades overlap each other when viewed in the direction in which the shaft extends.

8. A transport device comprising:

a tube that has a curved portion and a hollow space formed in the tube;

the transport member according to claim 1 that is disposed in the hollow space and that has a flexible portion at which the plurality of blades are disposed, the flexible portion being disposed in the curved portion; and a driving unit that drives the transport member so that the transport member rotates, wherein a target object that is to be transported and that is present in the hollow space is transported.

9. An image forming apparatus comprising:

an image forming unit that forms a toner image; and the transport device according to claim 8 that transports a toner that is the target object.

10. The image forming apparatus according to claim 9, wherein the image forming unit includes an image holding unit that holds a toner image and transfers the toner image onto a to-be-transferred member and a cleaning unit that removes, from the image holding unit, a toner that remains in a region of the image holding unit after the toner image has been transferred, wherein the image forming apparatus further includes a storage unit that stores the toner removed from the image holding unit, and wherein the transport device is a device that transports the toner from the cleaning unit to the storage unit.

11. The transport member according to claim 1, wherein the slit is formed by cutting the helical blade from the tip end of the helical blade that is located farthest from the shaft toward the shaft.

12. The transport member according to claim 11, wherein the slit is formed by cutting the helical blade from the tip end of the helical blade that is located farthest from the shaft to a surface of the shaft.

* * * * *